United States Patent [19]

LaBrosse et al.

[11] Patent Number: 4,724,175

[45] Date of Patent: Feb. 9, 1988

[54] PREFABRICATED BOW FORM

[75] Inventors: Paul R. LaBrosse, South St. Paul; Daniel P. Pohl, Grant Township, Washington County; Bernard S. Truskolaski, Lake Elmo, all of Minn.

[73] Assignee: Minnesota Mining and Manufacturing Company, St. Paul, Minn.

[21] Appl. No.: 941,025

[22] Filed: Dec. 12, 1986

[51] Int. Cl.[4] ..... D04D 7/10

[52] U.S. Cl. ..... 428/4; 156/70; 428/101; 428/198

[58] Field of Search ..... 428/4, 5, 101, 198; 156/70

[56] References Cited

U.S. PATENT DOCUMENTS

| | | | |
|---|---|---|---|
| 3,637,455 | 1/1972 | Pearson et al. | 428/4 |
| 3,954,212 | 5/1976 | Bolis | 428/4 X |
| 4,329,382 | 5/1982 | Truskolaski et al. | 428/4 |
| 4,476,168 | 10/1984 | Aoyama | 428/4 |
| 4,515,837 | 5/1985 | Cheng | 428/4 |
| 4,608,283 | 8/1986 | White | 428/4 |
| 4,634,612 | 1/1987 | Nelson et al. | 428/4 |

*Primary Examiner*—Henry F. Epstein

*Attorney, Agent, or Firm*—Donald M. Sell; James A. Smith; Leland D. Schultz

[57] ABSTRACT

A prefabricated bow form comprising sets of loop forming portions that are oriented relative to each other by generally triangular portions of the bow form when the bow is formed. The bow form can be configured to form bows that have the shape of Pom bows or shapes similar to Pom bows.

6 Claims, 4 Drawing Figures

PREFABRICATED BOW FORM

TECHNICAL FIELD

This invention relates to prefabricated bow forms.

BACKGROUND ART

Several U.S. patents including U.S. Pat. Nos. 3,637,455; 3,954,212; 4,329,382; 4,476,168 and 4,515,837 have described prefabricated bow forms of the type comprising two bow ribbons disposed in opposed relationship, and at least one pull string or tie ribbon (called tie ribbon hereinafter) disposed centrally between the bow ribbons, with first ends of the bow and tie ribbons bonded together, and the bow ribbons being bonded together at a plurality of spaced bonded areas adjacent both longitudinal edges of the tie ribbon so that the tie ribbon is unbonded to the bow ribbons but is constrained between the bow ribbons. The spaced bonded areas define lines extending across the bow ribbons about which the bow ribbons will fold to form loops when the bonded areas of the bow ribbons are gathered together adjacent the first ends of the bow ribbons, which gathering is done either by pushing the bonded areas farthest from the first ends toward the first ends while the tie ribbon is held by its second end, by pulling on the second end of the tie ribbon while the bow ribbons are held adjacent the bonded areas closest to their second ends, or a combination of such pushing and pulling.

Of the patents described above, U.S. Pat. Nos. 3,637,455; 3,954,212; and 4,515,837 have described such prefabricated bow forms specifically intended to form a Pom bow (which may be called a pompom bow or a pompon bow by some), which is a generally hemispherically shaped bow defined by a plurality of loops of generally the same length generally evenly distributed about and projecting from a center of the bow radially outwardly and progressively upwardly toward the top of the bow to define a generally hemispherical periphery with no visually significant open areas.

The bow ribbons in the prefabricated bow forms for Pom bows described in those patents, however, have been notched to facilitate positioning the loops in the radial and upward pattern to form the desired generally hemispherical Pom shape, which positioning typically required manual manipulation of the loops after they were formed. Also, such notching added expense to making the bow form and restricted the width of the tie ribbon that could be used in the bow form.

U.S. Pat. No. 4,476,168 describes a prefabricated bow form that is closest in its structural features to the prefabricated bow form described herein in that it describes unnotched bow ribbons bonded together at spaced bonded areas with relatively wide tie ribbons therebetween, which tie ribbons can be tied or adhered around an item such as a package to which a bow made from the bow form is to be attached; and describes the use of such spaced bonded areas to define a combination of fold lines extending both normal to and at acute angles to the edges of the bow ribbons, with triangular sections of the ribbons between some of such differently oriented fold lines to cause loops to orient in different angular relationships radially of the bow formed with the bow form. The bows formed by the prefabricated bow forms described in that patent, however, either have loops positioned directly above each other in the form of a cross (FIG. 6) which is not a desired shape for a Pom bow, or have four loops at right angles to each other with loops above and below bisecting the angle formed between opposing loops (FIG. 13) which forms a bow that, while perhaps having its own appeal, also does not have the shape of a conventional Pom bow.

DISCLOSURE OF THE INVENTION

The present invention provides a prefabricated bow form which both can form a bow having the shape of a conventional Pom bow described above or other similar shapes using unnotched bow ribbons, and can include at least one and preferably two tie ribbons having a width only slightly less than the widths of the bow ribbons which form the bow, by which tie ribbons the bow can be tied to an object or package.

The prefabricated bow form according to the present invention comprises two bow ribbons of a first width disposed in opposed relationship, and at least one tie ribbon disposed centrally between the bow ribbons. Aligned first ends of the bow and tie ribbons are firmly bonded together, and the bow ribbons are bonded together at a plurality of spaced bonded areas adjacent both longitudinal edges of the tie ribbon so that the tie ribbon is unbonded to the bow ribbons but constrained between the bow ribbons. Those spaced bonded areas define imaginary fold lines extending across the bow ribbons about which the bow ribbons will fold when the bow is formed by gathering the bonded areas adjacent the first ends. The fold lines defined by the bonded areas include a generally central set of four adjacent fold lines disposed at acute included angles with the longitudinal edges of the bow ribbons defining therebetween three generally central loop forming portions on each of the bow ribbons, and spaced angled fold lines between the central set of fold lines and both ends of the bow ribbons also disposed at acute included angles with the longitudinal edges of the bow ribbons with the acute included angles with respect to each longitudinal edge being alternately disposed adjacent and opposite the first end. The angled fold lines between the central set of fold lines and the second ends of the bow ribbons form at least two loop forming portions on each of the bow ribbons and the angled fold lines between the central set of fold lines and the first ends form at least three loop forming portions on each of the bow ribbons. Also, each of the angled fold lines adjacent the central set of fold lines and the adjacent fold line of the central set form generally triangular portions on each of the bow ribbons at both ends of the central set of fold lines; and the fold lines further include a fold line generally at a right angle to the longitudinal edge of the bow ribbons between the bond at the first ends of the ribbons and the adjacent fold line of the angled set of fold line to form a generally triangular portion therebetween.

This prefabricated bow form structure can form a very full Pom bow including two sets of three opposed loops formed from the central loop forming portions, and loops both above and below those two set of opposed loops formed by the portions of the bow ribbons between its central portion and ends that are angularly displaced from the two sets of opposed loops by the triangular portions at their ends and project radially outwardly from the center of the bow at different angles with respect to those two sets of three opposed loops and with those two sets of three opposed loops progressively project more upwardly starting from the loops formed adjacent the second ends of the bow ribbons to define the generally hemispherical shape for the bow.

Also, preferably the prefabricated bow form includes two superimposed contacting tie ribbons having widths generally in the range of only about $\frac{1}{4}$ to $\frac{5}{8}$ inch less than the widths of the bow ribbons. Two tie ribbons of such width can be secured around an item or package to which the formed bow is applied, which can be a convenience and can add to the attractiveness of the item or package.

BRIEF DESCRIPTION OF THE DRAWING

The present invention will be more thoroughly described with reference to the accompanying drawing in which like numbers refer to like parts in the several views, and wherein.

DESCRIPTION OF THE PREFERRED EMBODIMENT

Figure 1:
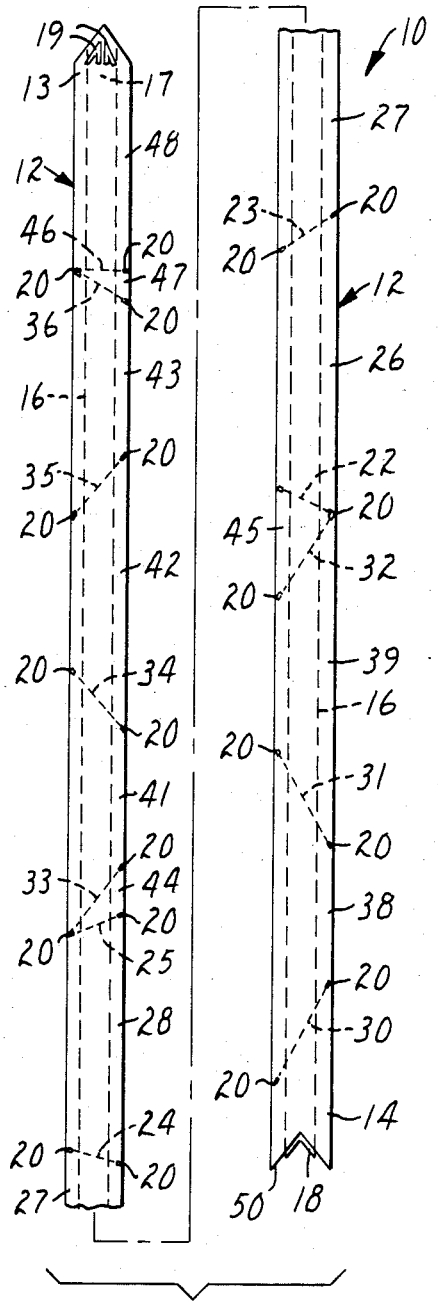
FIG. 1 is a plan view of a prefabricated bow form according to the present invention shown broken into two pieces.
Figure 2:
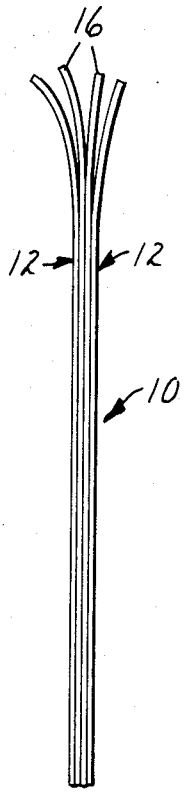
FIG. 2 is an enlarged fragmentary edge view of the prefabricated bow form of FIG. 1.

Referring now to FIGS. 1 and 2 of the drawing, there is shown a prefabricated bow form according to the present invention, generally designated by the reference numeral 10.

Generally, like prior art prefabricated bow forms the prefabricated bow form 10 comprises (1) two bow ribbons 12 of a first width having first and second ends 13 and 14 and disposed in opposed relationship; and (2) at least one, and as illustrated, preferably two tie ribbons 16 having first and second ends 17 and 18 and being disposed centrally between the bow ribbons 12. The first ends 13 and 17 of the bow and tie ribbons 16 are firmly bonded together at a generally arrowhead shaped end bond 19 formed by making two side by side generally V-shaped bonds, and the bow ribbons 12 are similarly bonded together at a plurality of spaced rectangular bonded areas 20 adjacent both longitudinal edges of the tie ribbons 16 so that the tie ribbons 16 are unbonded to the bow ribbons 12 but are constrained between the bow ribbons 12. The spaced bonded areas 20 define fold lines extending across the bow ribbons 12 about which the bow ribbons 12 will fold to form loops and a bow 21 when the bonded areas 20 of the bow ribbons 12 are gathered together adjacent the first ends 13 and 17 of the bow and tie ribbons 12 and 16 with the fold lines closely adjacent and generally parallel to each other. The fold lines cannot be seen on the bow form 10, but have been illustrated as dotted lines in FIG. 1 to facilitate understanding of the present invention. Such gathering of the bonded areas 20 at the first ends 13 and 17 to form the bow 21 is done either by pushing the bonded areas 20 farthest from the first ends 13 and 17 toward the first ends 13 and 17 while the tie ribbons 16 are held by their second ends 18, by pulling on the second ends 18 of the tie ribbons 17 while the bow ribbons 12 are held adjacent the bonded areas 20 adjacent their second ends 14, or a combination of such pushing and pulling.

In the present invention, these fold lines defined by the bonded areas 20 include a generally central set of four adjacent fold lines 22, 23, 24 and 25 disposed at acute included angles with respect to the longitudinal edges of the bow ribbons 12 with the acute included angles with respect to each longitudinal edge being alternately disposed adjacent and opposite the first ends 13. The central set of fold lines 22, 23, 24 and 25 define therebetween three generally central loop forming portions 26, 27 and 28 on each of the bow ribbons 12. These fold lines also include spaced angled fold lines 30 through 36 between the central set of fold lines and both ends 13 and 14 of the bow ribbons 12, which angled fold lines 30 through 36 are disposed at acute included angles with the longitudinal edges of the bow ribbons 12 with the acute included angles with respect to each longitudinal edge being alternately disposed adjacent and opposite the first ends 13. The angled fold lines 30, 31 and 32 between the central set of fold lines 22, 23, 24 and 25 and the second ends 14 of the bow ribbons 12 form two loop forming portions 38 and 39 on each of the bow ribbons 12, and the acute angle fold lines 33, 34, 35 and 36 between the central set of fold lines 22, 23, 24 and 25 and the first ends 13 and 17 form three loop forming portions 41, 42 and 43 on each of the bow ribbons 12. The angled fold lines 32 and 33 adjacent the outermost fold lines 22 and 25 respectively of the central set of fold lines form generally triangular portions 44 and 45 on each of the bow ribbons 12, with each of the triangular portions 44 and 45 at a different end of the central loop forming portions 26, 27 and 28. The triangular portions 44 and 45 provide special functions in shaping the bow 21 as will later be described. Also, the fold lines include a fold line 46 generally at a right angle to the longitudinal edges of the bow ribbons 12 and located between the bond 20 at the first ends 13 and 17 of the ribbons 12 and 16 and the adjacent fold line 36 of the angled set of fold lines to form with the fold line 36 a generally triangular portion 47 that also provides a special function described later in shaping the bow 21. The right angle fold line 46 and the bond 20 also define an end loop forming portion 48 on each of the bow ribbons 12.

The central set of fold lines 22, 23, 24 and 25 and the spaced angled fold lines 30 through 36 between the central loop forming portions 26, 27 and 28 and both ends 13 and 14 of the bow ribbons 12 are disposed at acute included angles in the range of 20 to 80 degrees with the longitudinal edges of the bow ribbons 12. As two examples developed by much experimentation for $\frac{7}{8}$ inch wide ribbon, when the fold lines 46, 36, 35, 34, 33, 25, 24, 23, 22, 32, 31, and 30 are disposed respectively at angles of 80, 55, 45, 40, 40, 75, 70, 60, 70, 30, 25 and 25 degrees respectively with respect to the edges of the bow ribbons 12, and the left end of those bond lines as illustrated in FIG. 1 are spaced respectively at about 3.65, 3.65, 7.78, 10.38, 14.72, 14.72, 18.44, 23.06, 27.13, 28.91, 31.66, and 37.13 inches from the end 13 of the bow ribbons a hemispherical Pom bow having a base diameter of about 4 inches will be formed.

Alternately, if those fold lines are disposed respectively at angles of 90, 70, 45, 45, 40, 75, 70, 70, 60, 30, 25, and 25 degrees respectively with respect to the edges of the bow ribbons 12 and the left end of those bond lines as illustrated in FIG. 1 are spaced respectively at about 2.14, 2.14, 5.38, 7.25, 11.19, 11.19, 14.72, 19.91, 24.56, 27.00, 30.38, and 36.25 from the end 13 of the bow ribbons a more flattened pom-like bow having a base diameter of about 5 inches will be formed.

Preferably the two tie ribbons 16 have widths generally in the range of about ¼ to ⅜ inch less than the widths of the bow ribbons 12, which provides sufficient edge margins on the bow ribbons 12 projecting past the longitudinal edges of the tie ribbons along which the bonded areas 20 between the bow ribbons 12 may be formed.

The end bond 19 and bonded areas 20 are preferably formed by heat bonding portions of the bow ribbons 12 together. The end bond and bonded areas could also be formed by many other means, however, such as by the use of suitable hot melt or other adhesives, or by the use of mechanical bonding devices such as metal or plastic clips, sewing thread, or rivets.

The first ends 13 and 17 of the bow and tie ribbons 12 and 16 preferably have a pointed shape, and the second ends 14 and 18 preferably have a V-shaped notch 50 that is both decorative and compliments the pointed shape of the first ends 13 and 17 so that the bow form 10 can be formed from continuous lengths of ribbon that are heat bonded together and cut apart with one V-shaped cut.

The bow and tie ribbons 12 and 16 may be formed from Sasheen TM brand ribbon available from Minnesota Mining and Manufacturing Company (3M), St. Paul, Minn. Sasheen TM brand ribbon has a nonwoven structure comprising longitudinally extending closely adjacent parallel acetate filaments providing its front surface and adhered to a layer of randomly arrayed polyester fibers that define its back surface. Such ribbon provides an attractive appearance and affords the use of heat bonding to form the end bond 19 and bonded areas 20. Other ribbon materials such as Decosheen TM brand ribbon which comprises unoriented pigmented polypropylene and which is also available from 3M can also be used, and may be preferred for certain purposes.

Figure 3:
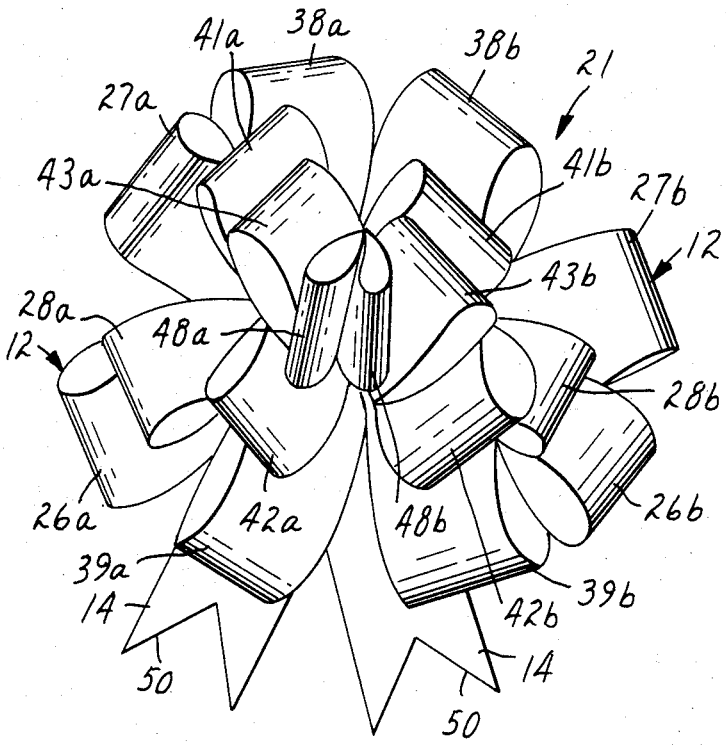
FIG. 3 is a top plan view of a Pom bow formed from the prefabricated bow form of FIG. 1.
Figure 4:
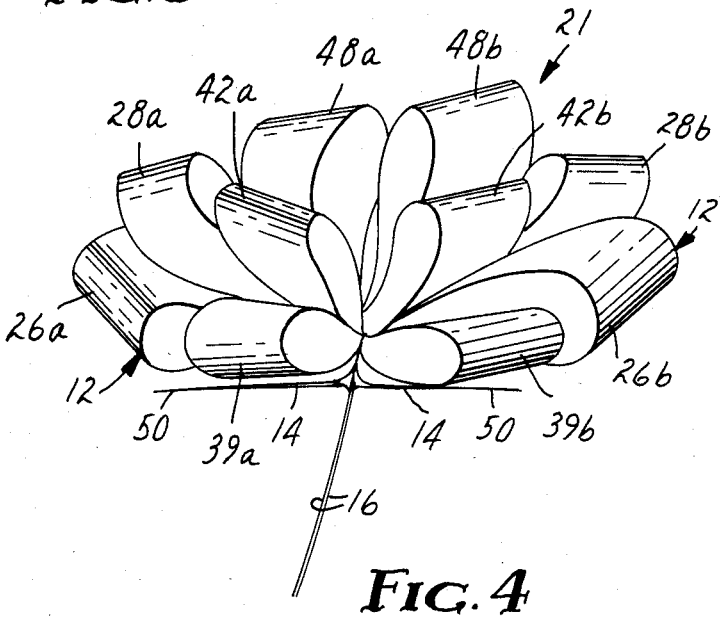
FIG. 4 is a side elevational view of the bow of FIG. 3.

As can be seen from FIGS. 3 and 4, the bow form 10 can form a very full Pom bow 21. To facilitate understanding the formation of the bow 21 from the bow form 10, loops formed from the loop forming portions on the two bow ribbons 12 shown in FIGS. 3 and 4 have been given the same numbers as the loop forming portions plus the suffix "a" on one bow ribbon 12 and the suffix "b" on the other bow ribbon 12. The bow 21 includes two sets of loops 26*a*, 27*a* and 28*a*; and 26*b*, 27*b* and 28*b* formed from the central loop forming portions 26, 27 and 28 and projecting away from each other with loops 26*a* and 27*a* closely adjacent and aligned with loops 27*b* and 26*b* respectively which are also closely adjacent so that the loops 26*a*, 27*a*, 26*b* and 27*b* are disposed generally in the shape of a bow tie. Loops 28*a* and 28*b* are disposed generally aligned over the adjacent edges of loops 26*a* and 27*a* and the adjacent edges of loops 26*b* and 27*b*, respectively. Loops both above and below those two sets of opposed loops 26*a*, 27*a* and 28*a*; and 26*b*, 27*b* and 28*b* formed by the loop forming portions 30 through 36 and 48 of each of the bow ribbons 12 between their central loop forming portions 26, 27 and 28 and their ends 13 and 14 project radially outwardly from the center of the bow 21 at different angles with respect to those sets of opposed loops 26*a*, 27*a* and 28*a*; and 26*b*, 27*b* and 28*b*, and with those sets of opposed loops 26*a*, 27*a* and 28*a*; and 26*b*, 27*b* and 28*b* progressively project more upwardly starting from the loops formed adjacent the second ends 14 of the bow ribbons 12 to define the generally hemispherical shape of the bow 21.

Specifically, the forming of the bow 21 proceeds as follows starting from the second ends 14 of the bow ribbons 12. First the loop forming portions 38 form loops 38*a* and 38*b* disposed side by side with their adjacent edges generally aligned with adjacent edges of the tie ribbons 16. Then, loop forming portions 39 form loops 39*a* and 39*b* with loop 39*a* opposite loop 38*b* and loop 39*b* opposite loop 38*a* to form a base for the Pom bow 21 generally in the shape of a bow tie, with the second ends 14 of the bow ribbons 12 projecting along and beyond the bottom surfaces of the loops 39*a* and 39*b*. Next the two sets of opposed loops 26*a*, 27*a* and 28*a*; and 26*b*, 27*b* and 28*b* are sequentially formed to provide the shape described above with the adjacent loops 26*a* and 27*a* filling the space between loops 38*a* and 39*a* and the adjacent loops 26*b* and 27*b* filling the space between loops 39*b* and 38*b* to provide a generally equal radial spacing of the loops 38*a*, 27*a*, 26*a*, 39*a*, 39*b*, 26*b*, 27*b*, and 38*b* to form a full base for the bow 21. This orientation of the two sets of opposed loops 26*a* and 27*a*; and 26*b* and 27*b*, is caused by the movement into general alignment of the fold lines 32 and 22 defining the triangular portion 45 between them, which triangular portion 45 forms a slight loop-like projection that is not noticed in the bow 21. Next, loop forming portions 41 form loops 41*a* and 41*b* which are generally centered over the adjacent edges of loops 38*a* and 27*a* and over the adjacent edges of loops 38*b* and 27*b* respectively because of the movement into general alignment of the fold lines 25 and 33 defining the triangular portion 44 therebetween (which triangular portion 44 also folds into a slight unnoticed projection), loop forming portions 42 form loops 42*a* and 42*b* generally centered over the adjacent edges of loops 26*a* and 39*a* and over the adjacent edges of loops 26*b* and 39*b* respectively, loop forming portions 43 form loops 43*a* and 43*b* generally aligned over loops 41*a* and 41*b* respectively; and loop forming portions 48 form loops 48*a* and 48*b* generally centered over the adjacent edges of loops 42*a* and 43*a* and over the adjacent edges of loops 42*b* and 43*b* respectively, which orientation of the two loops 48*a* and 48*b* is caused by the movement into general alignment of the fold lines 36 and 46 defining the triangular portion 47 between them, which triangular portion 47 then forms a slight loop-like projection that is not noticed in the bow 21. Gathering of the bonded portions 20 at the center of the Pom bow 21 to form such loops causes each loop to progressively project more upwardly starting from the base of the bow formed by the loops 38*a*, 38*b*, 39*a* and 39*b* toward the loops 48*a* and 48*b*. The close packing of the loops, slight differences in the acute angles of the fold lines 22–25 and 30–36, and the orienting effect of the triangular sections 44, 45 and 47, together with each loop being wider (in a direction normal to the surface of the bow ribbon 12) at the end of the loop than adjacent the bonded areas 20 causes the loops to position themselves in generally evenly distributed closely adjacent positions that form a generally hemispherical periphery for the Pom bow 21 that has no visually significant open spaces, even though some small open spaces occur around the base of the Pom bow 21.

The present invention has now been described with reference to one embodiment thereof. It will be apparent to those skilled in the art that many changes can be made in the embodiment described without departing from the scope of the present invention. Thus the scope of the present invention should not be limited to the structures described in this application, but only by structures described by the language of the claims and the equivalents of those structures.

We claim:

1. A prefabricated bow form comprising two bow ribbons of a first width having first and second ends and being disposed in opposed relationship, and at least one tie ribbon having first and second ends and being disposed centrally between said bow ribbons, the first ends of said bow and tie ribbons being firmly bonded together, said bow ribbons being bonded together at a plurality of spaced bonded areas adjacent both longitudinal edges of said tie ribbon so that said tie ribbon is unbonded to said bow ribbons but constrained between said bow ribbons, said spaced bonded areas defining fold lines extending across said bow ribbons about which fold lines the bow ribbons will fold when a bow is formed by gathering the bonded areas adjacent said first ends, said fold lines including a generally central set of four adjacent fold lines defining therebetween three generally central loop forming portions on each of said bow ribbons, and angled, spaced fold lines between said central set and both ends of said bow ribbons disposed at acute included angles with the longitudinal edges of said bow ribbons with said acute included angles with respect to each longitudinal edge being alternately disposed adjacent and opposite said first end, said angled fold lines between said central set and said second ends of said bow ribbons forming at least two loop forming portions on each of said bow ribbons, and said angled fold lines between said central set of fold lines and said first ends of said ribbons forming at least three loop forming portions on each of said bow ribbons, each of said angled fold lines adjacent said central set of fold lines and the adjacent fold lines of said central set of fold lines forming generally triangular portions on each of said bow ribbons at both ends of said central loop forming set, and said fold lines further including a fold line between said bond at the first ends of said ribbons and the adjacent fold line of said angled set of fold lines to form a generally triangular portion therebetween.

2. A prefabricated bow form according to claim 1 including two tie ribbons having widths generally in the range of only about $\frac{1}{4}$ to $\frac{3}{8}$ inch less than the widths of said bow ribbons.

3. A prefabricated bow form according to claim 1 wherein the fold line of said central set of fold lines are each disposed at an acute included angle with respect to the longitudinal edges of said bow ribbons with said acute included angles with respect to each longitudinal edge being alternately disposed adjacent and opposite said first end.

4. A prefabricated bow form according to claim 1 wherein said angled fold lines between said central set of fold lines and both ends of said bow ribbons are disposed at acute included angles in the range of 20 to 80 degrees with the longitudinal edges of said bow ribbons.

5. A prefabricated bow form according to claim 3 wherein said spaced angled fold lines between said central set of fold lines and said first ends of said bow ribbons are disposed sequentially starting from said central set of fold lines at acute included angles of about 40, 40, 45 and 55 degrees with respect to the edges of said bow ribbons, said spaced angled fold lines between said central set of fold lines and said second ends of said bow ribbons are disposed sequentially starting from said central set of fold lines at acute included angles of about 30, 25 and 25 degrees with respect to the edges of said bow ribbons, and said central set of fold lines are disposed sequentially starting from adjacent the first ends of said bow ribbons at acute included angles of about 75, 70, 60 and 70 degrees with respect to the edges of said bow ribbons.

6. A prefabricated bow form according to claim 3 wherein said spaced angled fold lines between said central set of fold lines and said first ends of said bow ribbons are disposed sequentially starting from said central set of fold lines at acute included angles of about 40, 45, 45 and 70 degrees with respect to the edges of said bow ribbons, said spaced angled fold lines between said central set of fold lines and said second ends of said bow ribbons are disposed sequentially starting from said central set of fold lines at acute included angles of about 60, 25 and 25 degrees with respect to the edges of said bow ribbons, and said central set of fold lines are disposed sequentially starting from adjacent the first ends of said bow ribbons at acute included angles of about 75, 70, 70 and 60 degrees with respect to the edges of said bow ribbons.

* * * * *